United States Patent [19]

Pritz

[11] 4,018,339

[45] Apr. 19, 1977

[54] ANTI-THEFT GUN PROTECTOR APPARATUS

[76] Inventor: Peter G. Pritz, c/o Trico non Ferrows Metal Products Inc., Wyandotte Road, Willow Grove, Pa. 19090

[22] Filed: June 11, 1976

[21] Appl. No.: 695,260

Related U.S. Application Data

[63] Continuation-in-part of Ser. No. 635,642, Nov. 26, 1975, abandoned.

[52] U.S. Cl. ..... 211/8; 70/58; 211/64; 248/203

[51] Int. Cl.[2] ..... F05B 73/00; A47F 7/00

[58] Field of Search ..... 211/4, 8, 9, 60 SK, 211/63, 64, 68; 248/203, 220.5, DIG. 3; 70/57, 58, 59, 61, 62; 224/1 R, 2 A, 2 C; 42/1 LP

[56] References Cited

UNITED STATES PATENTS

| | | | |
|---|---|---|---|
| 505,320 | 9/1893 | Meadows | 211/4 X |
| 554,252 | 2/1896 | Falk | 211/64 |
| 1,202,588 | 10/1916 | Roberts | 211/64 X |
| 2,108,402 | 2/1938 | Dennin | 211/9 X |
| 2,287,805 | 6/1942 | Johnson | 211/64 |
| 2,327,334 | 8/1943 | Parker | 70/57 X |
| 2,783,896 | 3/1957 | Agostini et al. | 211/64 |
| 2,998,885 | 9/1961 | Surface | 211/64 |
| 3,685,667 | 8/1972 | Bell | 211/60 SK |
| 3,802,612 | 4/1974 | Smith | 211/8 X |
| 3,917,071 | 11/1975 | Walters | 211/4 X |

FOREIGN PATENTS OR APPLICATIONS

| | | | |
|---|---|---|---|
| 779,778 | 3/1968 | Canada | 211/48 |
| 174,302 | 1/1935 | Switzerland | 211/8 |

*Primary Examiner*—Roy D. Frazier
*Assistant Examiner*—Thomas J. Holko
*Attorney, Agent, or Firm*—Z. T. Wobensmith, 2nd; Z. T. Wobensmith, III

[57] ABSTRACT

Anti-theft gun protector apparatus is disclosed useful for the display of rifles and shotguns of varying lengths and calibers, which includes a plate member fixedly mounted to a multipart mounting box carried on a wall or other surface, a locking box slidably mounted to the plate with a resiliently urged catch therein which is normally positioned for engagement with one of a plurality of openings along the face of the plate. The catch has a portion for contact by a lock controlled arm to retract the catch from engagement in an opening along the plate. The locking box normally remains in a selected position on the plate unless the catch is retracted. The locking box has a tapered pin thereon which engages in the end of the gun barrel with the gun having the butt end of its stock carried in a fixed cup with a resilient pad therein.

8 Claims, 4 Drawing Figures

2
69
68
70
61
71
55
46
44
41
48
85
51
42
59
35
43
70
61
68
11
10
21
12
16
27
20

2
57
69
68
70
61
21
63
58
56
71
52
45
88
44
91
43
3
80
89
78
76
85
87
86
77
75
79
52
45
42
40
37
35
32
31
61
57
70
68
69
21
11
10

12
27
14
20
16
26
25
22

ANTI-THEFT GUN PROTECTOR APPARATUS

CROSS REFERENCE TO RELATED APPLICATION

This application is a continuation in part of my prior application of patent for Anti-Theft Gun Protector Apparatus, filed Nov. 26, 1975, Ser. No. 635,642, and now abandoned

BACKGROUND OF THE INVENTION

1. Field of the Invention

This invention relates to anti-theft gun protector apparatus of the type which restrains the gun at the end of its barrel and at the butt end of the stock.

2. Description of the Prior Art

The rise in crime and increase in shoplifting of guns has led to many devices which attempt to safequard guns while they are displayed for sale but provide ready access when desired. Examples of such structures are shown in the U.S. Patents to Meadows, U.S. Pat. No. 505,320, Falk, U.S. Pat. No. 554,252, Roberts, U.S. Pat. No. 1,202,588, Johnson, U.S. Pat. No. 2,287,805, Agostini et al., U.S. Pat. No. 2,783,896, Surface, U.S. Pat. No. 2,998,885, Bowen, U.S. Pat. No. 3,291,317, Pinkerton et al., U.S. Pat. No. 3,767,093, Anderson, U.S. Pat. No. 3,635,433, and Walters, U.S. Pat. No. 3,917,071.

Of these, Falk, Johnson, Smith, Pinkerton and Bowen are limited to guns of fixed size and shape. Roberts requires all the guns stored to be of the same length. Walters is restricted to storage of guns with one external diameter of barrel. The Meadows and Agostini et al. structures are complicated and expensive to construct. Surface shows a rack but no key locking provisions.

While these devices perform satisfactorily for the limited uses for which they are designed they lack the versatility of the structure of the present invention, and are not satisfactory for use with the large variety of rifles and shotguns presently available. The Bowen device is typical of a wooden gun rack which is widely used and which has a U-shaped recess wherein the end of the gun barrel is carried with a movable bar closing off the front of the opening. Such devices, however, are not suitable for guns of varying lengths and diameters of barrels and do not provide the degree of security desired.

The apparatus of my invention does not suffer from the defects of prior art devices and provides many advantages heretofore not available.

SUMMARY OF THE INVENTION

This invention relates to anti-theft gun protector apparatus which includes a plate fixedly mounted to a multipart mounting box carried on a wall or other surface and having a slidably mounted locking box with a catch therein normally positioned for engagement with one of a plurality of openings along the face of the plate to retain the locking box in a fixed position. The locking box has a pin which engages in the barrel of the gun to be secured. A lock is provided which can engage the catch and retract it from engagement in the openings. The stock of the gun is carried in a fixed cup.

The principal object of the invention is to provide anti-theft gun protector apparatus that can be used with a variety of calibers and lengths of guns.

A further object of the invention is to provide anti-theft gun protector apparatus that provides positive protection but ready access to the gun as desired.

A further object of the invention is to provide anti-theft gun protector apparatus that is easily and quickly installed.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figures 1, 2:
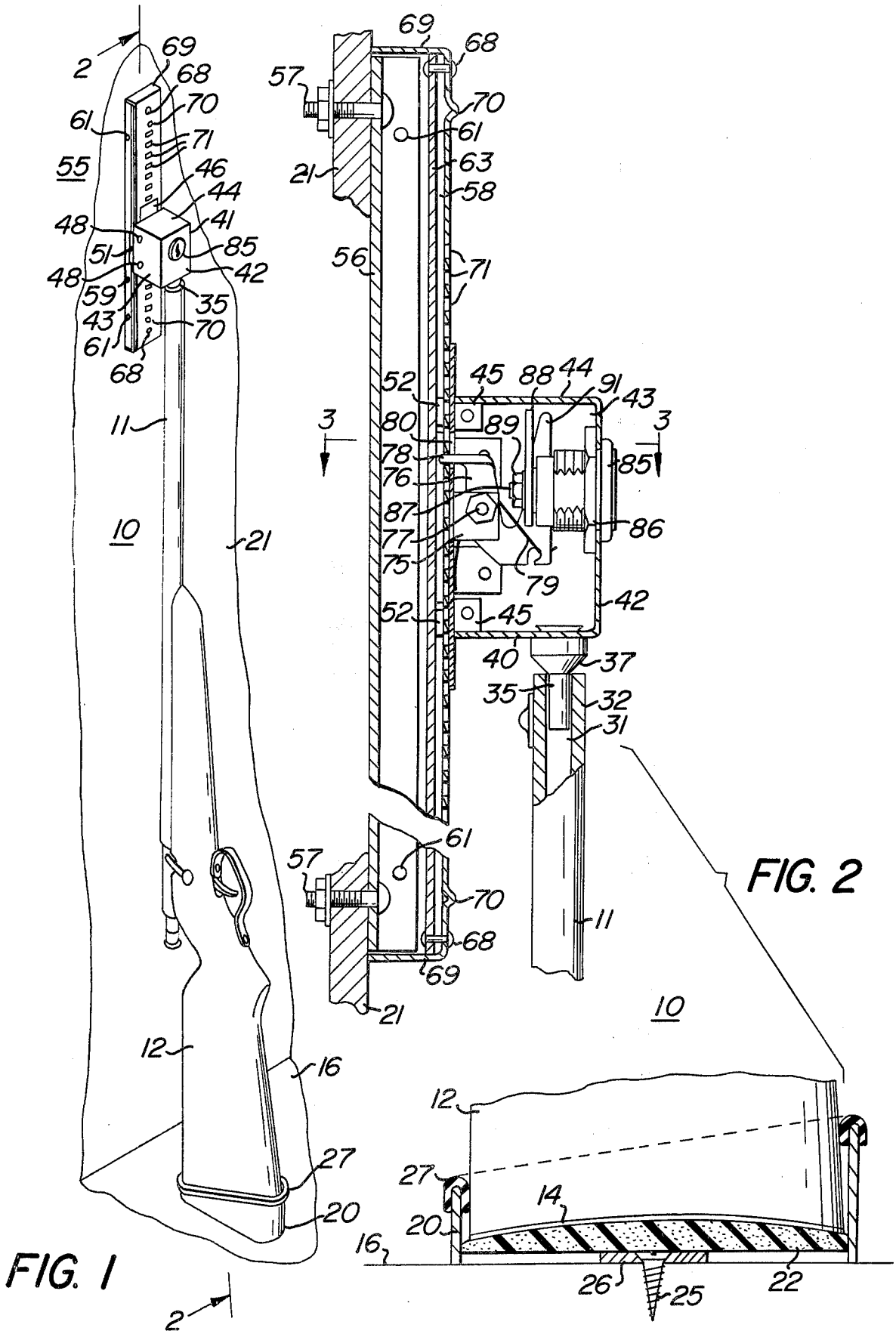
FIG. 1 is a view in perspective of the apparatus of my invention with a gun therein secured from theft.
FIG. 2 is a vertical sectional view, enlarged, taken approximately on the line 2—2 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, anti-theft apparatus is illustrated with a gun 10 engaged therewith which gun has a barrel 11 and fixed stock 12 with attached butt plate 14.

The gun 10 is illustrated as a bolt action rifle, however, any conventional rifle or shotgun with a fixed stock can be secured from theft with my invention.

The buttplate 14 is illustrated as supported by a floor 16 and enclosed along with the lower end of the stock 12 in a cup 20 which is oval shape in plan view with the end nearest the vertical wall 21 being of the lesser height. A synthetic plastic foam pad 22 is provided in the cup 20 to cushion and protect the stock 12 and permit of slight vertical accommodating movement. stock 12 in a cup 29 which is oval shape The cup 20 is preferably fabricated of metal and is secured to the floor 16 by one or more screws 25 engaged with plate 26 of cup 20 and extending into the floor 16. The cup 20 at its upper margin has a collar 27 extending therearound which collar 27 provides a cushioning action to the stock 12 and also helps to retain the stock 12 in the cup 20.

The collar 27 can be formed of rubber, natural or synthetic, or of any other suitable materials which are resilient and resistant to abrasion.

Figure 3:
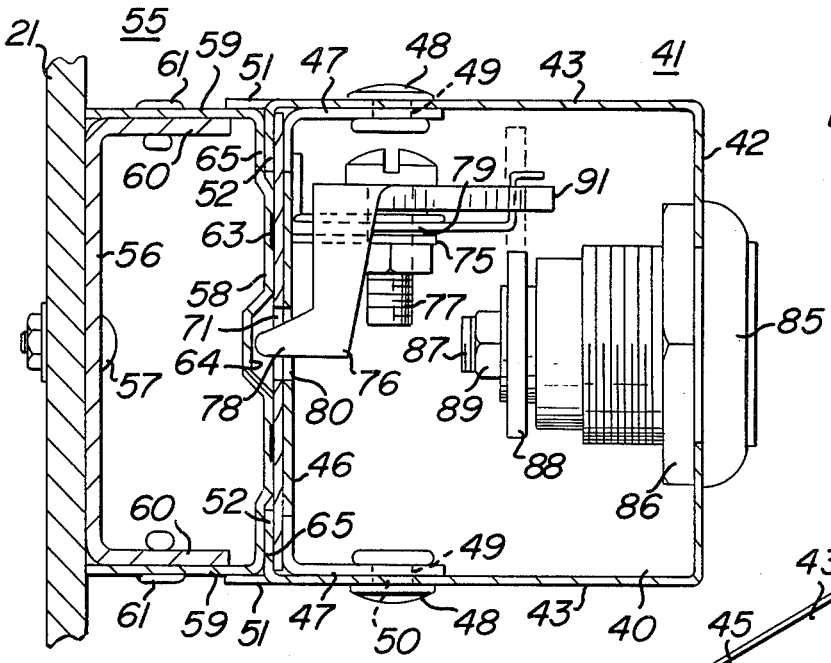
FIG. 3 is a horizontal sectional view, still further enlarged, taken approximately on the line 3—3 of FIG. 2.

The barrel 11 of the gun 10 has a bore 31 therein, and at its exit end 32 has a pin 35 engaged therewith as shown in FIGS. 2 and 3 which pin 35 has tapered shank 37 for accommodation of different sizes of bores. The pin 35 is secured in the horizontal bottom wall 40 of a locking box 41.

The box 41, of generally rectangular configuration, has a vertical front wall 42, vertical side walls 43 and a horizontal top wall 44. The bottom wall 40 and the top wall 44 have tabs 45 welded to the side walls 43 for greater strength and security.

The box 41 is closed at its rear end by a closure and guide plate 46 which has forwardly extending flanges 47 which are secured to the side walls 43 by rivets 48 extending through openings 49 in the flanges 47 and openings 50 in the side walls 43.

The box 41 has rearwardly extending guide extensions 51 and upper and lower guide flanges 52.

The locking box 41 is slidably carried on a wall mounting box 55 which has a rear interiorly disposed channel portion 56 for securing the box 55 to the wall 21 by bolts 57 or other secure fasteners.

The wall mounting box 55 has a front channel portion 58 with side flanges 59 secured to the side flanges 60 of the channel portion 56 by rivets 61.

The front wall 63 of the front channel portion 58 has a central vertical relief groove 64 and vertical side flat guide faces 65.

A ratchet plate 67 covers the front wall portion 63 of the front channel portion 58 and is secured thereto by upper and lower rivets 68.

The ratchet plate 67 has upper and lower end portions 69 which extend inwardly and cover the ends of the channel portions 56 and 58, upper and lower projections 70 which serve as limit stops for limiting the vertical movement of the locking box 41.

The plate 67 is provided with a central vertical row of openings 71.

Figure 4:
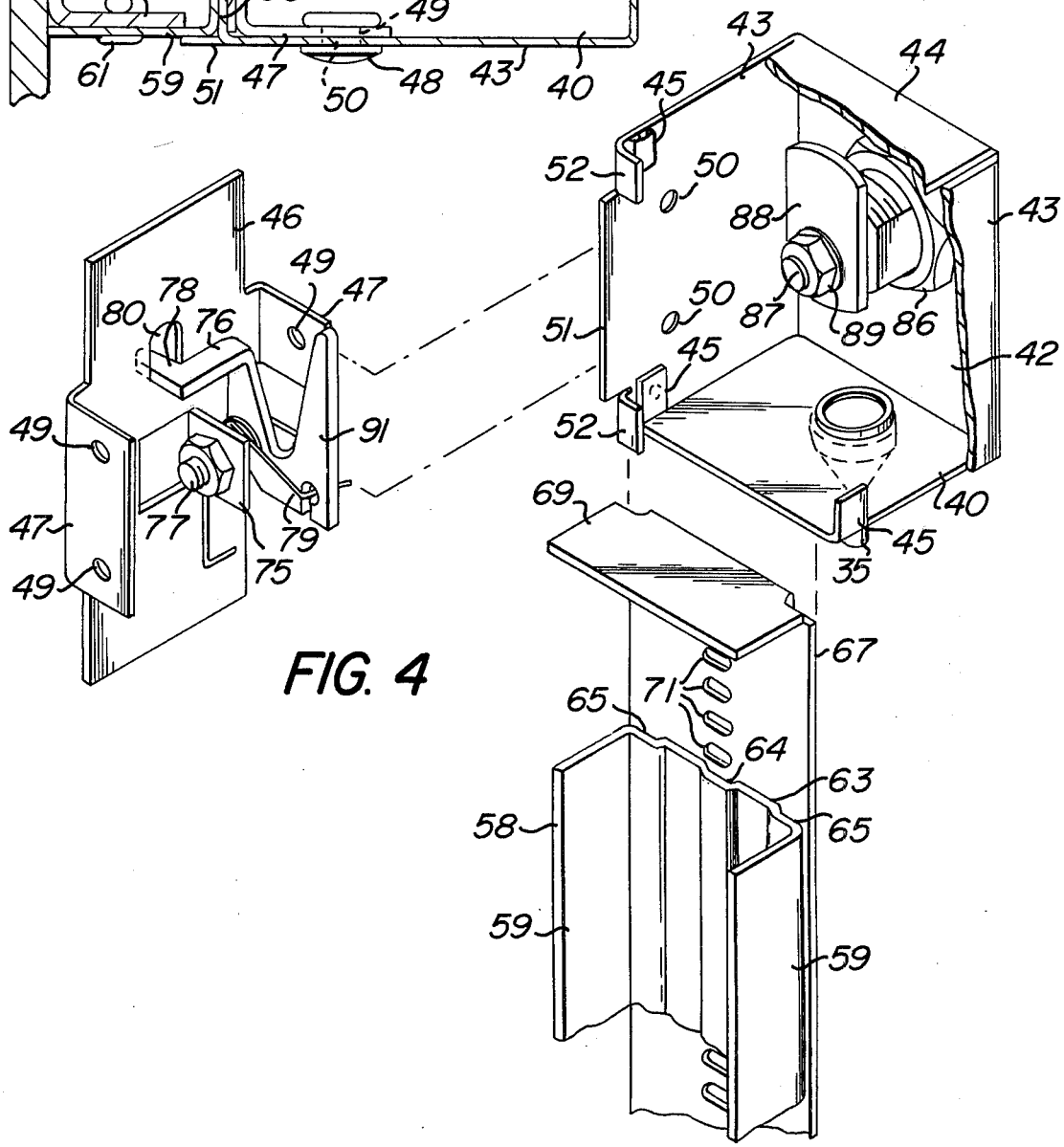
FIG. 4 is an exploded perspective view of the apparatus of my invention partially broken away to reveal the inner mechanism.

The plate 44 of box 41 has a bracket 75 secured thereto or struck out therefrom, as seen in FIGS. 2, 3 and 4, with a catch 76 rotatably mounted thereto by a bolt 77. The catch 76 has its end 78 extending through an opening 80 and is resiliently urged by a spring 79 to a position for engagement with one of the openings 71 in plate 67. The front wall 42 has cylinder lock 85 of well known type mounted thereon and held by a nut 86. The lock 85 has a shaft 87 which has a rectangular catch control member 88 retained thereon by nut 89.

The control member 88 is rotated by the shaft 67 and engages the arm 91 of the catch 56 to retract the catch end 58 against the force of the spring 79 from its engagement in an opening 71.

In use, the key is turned to move the shaft 87 and the control member 88 to move the arm 91 to retract the catch 56 so that the locking box 41 can be freely moved upwardly to permit of insertion of the gun 10 and the control member 88 is positioned out of retracting engagement with the arm 91. The actuating key (not shown) for the lock 85 is removed with the plate 88 in its non-retracting position. The locking box 41 is supported and guided by the flanges 52 which extend between the guide faces 65 and the plate 67 and by the guiding flanges 51 movable along the flanges 59.

The gun 10 to be secured has its stock 12 and butt plate 14 placed in the cup 20 and the barrel end 32 is positioned near the mounting box 41.

The mounting box 41 is moved downwardly with the catch end 78 successively engaging in openings 71 in the plate 67 and the pin 35 is positioned in the barrel 11. The catch end 78, in its downward movement, can be moved from opening 71 to opening 71 with a ratchet action. Upward movement of the box 41 is prevented by the engagement of the catch end 78 in any opening 71.

The gun 10 will be securely held against unauthorized removal.

When it is desired to remove the gun 10, the key (not shown) is inserted and the lock 85 is actuated to move the control plate 88 into engagement with the catch arm 91 and retract the catch 76 and move the catch end 78 out of the opening 71 in which it is engaged whereupon the box 41 can be slid upwardly to remove the pin 35 from the bore 31. The gun 10 can then be removed from cup 20.

The apparatus can be reused as desired with the particular opening 71 selected depending on the length of gun to be secured, the cushion 22 providing limited accommodation for catch end engagement.

It will thus be seen that an anti-theft gun protector apparatus has been provided with which the objects of the invention are achieved.

I claim:

1. Anti-theft gun protector apparatus for use with a rifle or shotgun having a barrel and a fixed stock which comprises fixedly mounted cup means horizontally disposed to receive said gun stock, fixedly mounted vertically disposed mounting means comprising a vertical portion having a vertical face and vertical flanges and a mounting plate member secured to said vertical portion and having a front face, said front face having a plurality of vertically disposed spaced openings, locking box means vertically slidably carried with respect to said mounting plate member, said box means including a guide plate member movable along said mounting plate member, pin means carried by said box means to engage the barrel of the gun, resiliently urged latch means carried in said box means and having an end portion for selective engagement in one of said vertically spaced openings, and lock means carried by said box means to control the positioning of said latch means in holding or retracted position.

2. Anti-theft gun protector apparatus as defined in claim 1 in which said cup means is an oval shaped cup which has an upper end with a portion higher than the remaining portions and is provided with a resilient collar around said upper end.

3. Anti-theft gun protector apparatus as defined in claim 1 in which said vertical portion has guide surfaces in spaced relation to said mounting plate member.

4. Anti-theft gun protector apparatus as defined in claim 3 in which said box means has retaining portions disposed between said guide surfaces and said mounting plate member.

5. Anti-theft gun protector apparatus as defined in claim 1 in which said pin means is carried on a bottom wall of said box means.

6. Anti-theft gun protector apparatus as defined in claim 1 in which said latch means comprises a catch which has a spring resiliently urging its end in a predetermined direction with respect to said openings.

7. Anti-theft gun protector apparatus as defined in claim 1 in which said latch means comprises a catch which has a spring resiliently urging its end into engagement with one of said openings.

8. Anti-theft gun protector apparatus as defined in claim 1 in which said lock means is a cylinder lock mounted to said box means which has a portion thereon which is movable to control the position of said latch means for engagement and disengagement of said catch member.

* * * * *